US012092096B2

(12) United States Patent
Lewis et al.

(10) Patent No.: US 12,092,096 B2
(45) Date of Patent: Sep. 17, 2024

(54) SYSTEM, APPARATUS, AND METHOD FOR MOTOR SPEED CONTROL

(71) Applicant: Hydrocision, Inc., North Billerica, MA (US)

(72) Inventors: Mark Lewis, Haverhill, MA (US); David E. Cassidy, Chelmsford, MA (US)

(73) Assignee: HydroCision, Inc., North Billerica, MA (US)

( * ) Notice: Subject to any disclaimer, the term of this patent is extended or adjusted under 35 U.S.C. 154(b) by 108 days.

(21) Appl. No.: 17/522,850

(22) Filed: Nov. 9, 2021

(65) Prior Publication Data

US 2022/0145875 A1 May 12, 2022

Related U.S. Application Data

(60) Provisional application No. 63/111,136, filed on Nov. 9, 2020.

(51) Int. Cl.

| | |
|---|---|
| ***F04B 49/20*** | (2006.01) |
| ***F04B 35/04*** | (2006.01) |
| ***F04B 49/06*** | (2006.01) |

(52) U.S. Cl.

CPC ..... *F04B 49/20* (2013.01); *F04B 35/04* (2013.01); *F04B 49/065* (2013.01); *F04B 2201/0201* (2013.01); *F04B 2201/0202* (2013.01)

(58) Field of Classification Search

CPC ..... F04B 29/40; F04B 2201/0202–0203

(Continued)

(56) References Cited

U.S. PATENT DOCUMENTS 3,093,152 A * 6/1963 Johnston ..... F15B 13/04 137/535
4,164,995 A * 8/1979 McFarland ..... A01D 41/12 192/103 C (Continued)

OTHER PUBLICATIONS

Wikipedia page for Hydraulic cylinder, published Oct. 2020, (URL: https://en.wikipedia.org/w/index.php?title=Hydraulic_cylinder&oldid=983344157) (Year: 2020).*

(Continued)

*Primary Examiner* — Thomas Fink

(74) *Attorney, Agent, or Firm* — Bochner PLLC; Andrew D. Bochner

(57) ABSTRACT

Provided for may be a motor speed control apparatus for use with a piston pump. The piston may be adapted to create a plurality of compressions and the piston may have a compression path and a decompression path. Further, the piston cylinder may include a proximal end, a distal end, and a piston length. The piston cylinder may have a proximal threshold position and a distal threshold position. In an embodiment, the apparatus includes a proximal and a distal hall effect sensor. The apparatus may comprise a computer, wherein instructions instruct the piston to decelerate at the distal threshold position during the compression path and the proximal threshold position during the decompression path, and/or wherein the computer executable instructions instruct the piston to accelerate at the distal threshold position during the decompression path and the proximal threshold position during the compression path.

20 Claims, 4 Drawing Sheets

(58) Field of Classification Search
USPC ..... 417/326
See application file for complete search history.

(56) References Cited

U.S. PATENT DOCUMENTS 4,848,085 A * 7/1989 Rosman ..... E21B 43/127 60/381
5,924,975 A 7/1999 Goldowsky
6,979,181 B1 * 12/2005 Kidd ..... F04B 49/065 318/432
2004/0247445 A1 12/2004 Nelson
2005/0142012 A1 * 6/2005 Padgett ..... F04B 9/1172 417/460
2008/0310969 A1 * 12/2008 Hogan ..... B01F 25/60 417/63
2009/0047144 A1 * 2/2009 Leece ..... F04B 25/005 417/415
2010/0143161 A1 * 6/2010 Hogan ..... F04B 7/06 417/500
2011/0236236 A1 9/2011 Larsen
2014/0072451 A1 * 3/2014 Schwarz ..... F04B 49/20 417/44.1
2016/0356269 A1 12/2016 Gutierrez
2017/0321526 A1 * 11/2017 McCarthy ..... F04B 41/02
2018/0360469 A1 12/2018 Shelton
2019/0353147 A1 * 11/2019 Bussiere ..... F04B 49/20
2021/0340964 A1 * 11/2021 Hofer ..... F04B 15/02

OTHER PUBLICATIONS

Wikipedia page for Pulse-width modulation, published Aug. 2020, (URL: https://en.wikipedia.org/w/index.php?title=Pulse-width_modulation&oldid=973206164) (Year: 2020).*
International Search Report and Written Opinion of the International Searching Authority in relation to international application No. PCT/US2021/058674, dated Feb. 17, 2022, 7 pages.

* cited by examiner

SYSTEM, APPARATUS, AND METHOD FOR MOTOR SPEED CONTROL

CLAIM OF PRIORITY

This application claims priority from U.S. Provisional Patent Application No. 63/111,136, filed on Nov. 9, 2020, the contents of which are incorporated herein by reference.

FIELD OF THE INVENTION

The present disclosure relates to a medical device. More specifically, the present disclosure relates to a system, apparatus, and method configured to control the speed of a piston before and after compression.

INTRODUCTION

Pumps and pump technology have been used in various applications since nearly the beginning of civilization. In 2000 BC, Egyptians used a very primitive system for pump that was no more sophisticated than a bucket used to raise water from wells. Today, modern industries have come to advance and use pump technology in a myriad of complex ways.

In particular, modern pumps have widespread usage in the field of medical procedures and research. Often a medical professional is required to quickly and effectively remove hazardous material from a patient's body. In such an instance, a mechanical device, such as a pump is needed. The benefit of many of the pumps used in hospitals and research facilities is that they rapidly and precisely remove material. Furthermore, the return pipe of these devices safely and expediently siphons the unwanted material into a waste collection system where the unwanted material may be properly disposed of.

In particular, many modern pumps are piston pumps. Piston pumps can be used to facilitate the movement of fluids, utilizing positive displacement technology and a pressure differential to reciprocate the piston. Typically, piston pumps are used in devices where a constant, high pressure is needed, such as water delivery systems for agriculture.

Although piston pumps have found there way into many fields and industries, there are some notable disadvantages. First, piston pumps contain a number of mechanical parts that are susceptible to wear. Thus, piston pumps may need to be replaced or maintained frequently, increasing the cost to operate the machinery. Second, piston pumps are generally quite heavy because both the pump itself and the driveshaft are made from sturdy materials. Third, because of the increased weight and size of a piston pump, frequently a piston pump will require more power to run, thus increasing operating costs.

Another significant drawback of piston pumps is that the piston pump moves fluid in pulses. Consequently, the piston pump uses energy in pulses, as well. Introducing a flywheel or counter balance into the system may reduce the peak energy required to operate the piston pump. However, the addition of a flywheel or counter balance may increase the cost to manufacture, the cost to run, and the overall weight of the device.

Further, because the piston in a piston pump moves in pulses, the pump as a whole is prone to intense vibrations. While for certain applications a vibrating pump may be tolerable, in many applications vibrations cause noise pollution, excessively ware other components of the device, and make precise measurements more difficult. For example, operators of precision medical equipment are disadvantaged when the pump vibrates because an operator may need to hold a scalpel, siphon, or other tool in an incredibly specific place on a patient's body.

It would be desirable, therefore, to provide systems and methods that rectify the deficiencies of the modern piston pump by decreasing the power supply rating such that the power supply does not need to supply peak currents. It would be desirable to provide systems and methods that decrease the piston pump's weight and cost by allowing the piston pump to operate without a heavy flywheel or counter balance.

It would yet be further desirable to combat the many drawbacks of the modern piston pump, especially related to its use in precise operations.

SUMMARY

The invention of the present disclosure may include a motor speed control apparatus for use with a piston pump comprising a piston held captive within the piston pump, the piston configured to travel linearly within a piston cylinder. The piston may be adapted to create a plurality of compressions and the piston may have a compression path and a decompression path. Further, the piston cylinder may include a proximal end, a distal end, and a piston length bound by the proximal end and the distal end. The piston cylinder may have a proximal threshold position and a distal threshold position. In an embodiment, the apparatus further includes a proximal hall effect sensor disposed on an outside surface of the proximal end of the piston cylinder and a distal hall effect sensor disposed on the outside surface of the distal end of the piston cylinder. In a further embodiment, the apparatus comprises a computer comprising one or more processors, one or more computer-readable memories, and one or more computer-readable storage devices, and program instructions stored on at least one of the one or more storage devices for execution by at least one of the one or more processors via at least one of the one or more memories, wherein the computer is in electrical communication with at least the proximal hall effect sensor and the distal hall effect sensor, wherein the memory contains computer executable instructions configured to decrease the speed of the piston before each of the plurality of compressions and increase the speed of the piston after each of the plurality of compressions, wherein the computer executable instructions instruct the piston to begin decelerating at the distal threshold position during the compression path and the proximal threshold position during the decompression path, and/or wherein the computer executable instructions instruct the piston to begin accelerating at the distal threshold position during the decompression path and the proximal threshold position during the compression path.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

For this disclosure, singular words should be construed to include their plural meaning, unless explicitly stated otherwise. Additionally, the term "including" is not limiting. Further, "or" is equivalent to "and/or," unless explicitly stated otherwise. Although, ranges may be stated as preferred, unless stated explicitly, there may exist embodiments that operate outside of preferred ranges.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Figure 1:
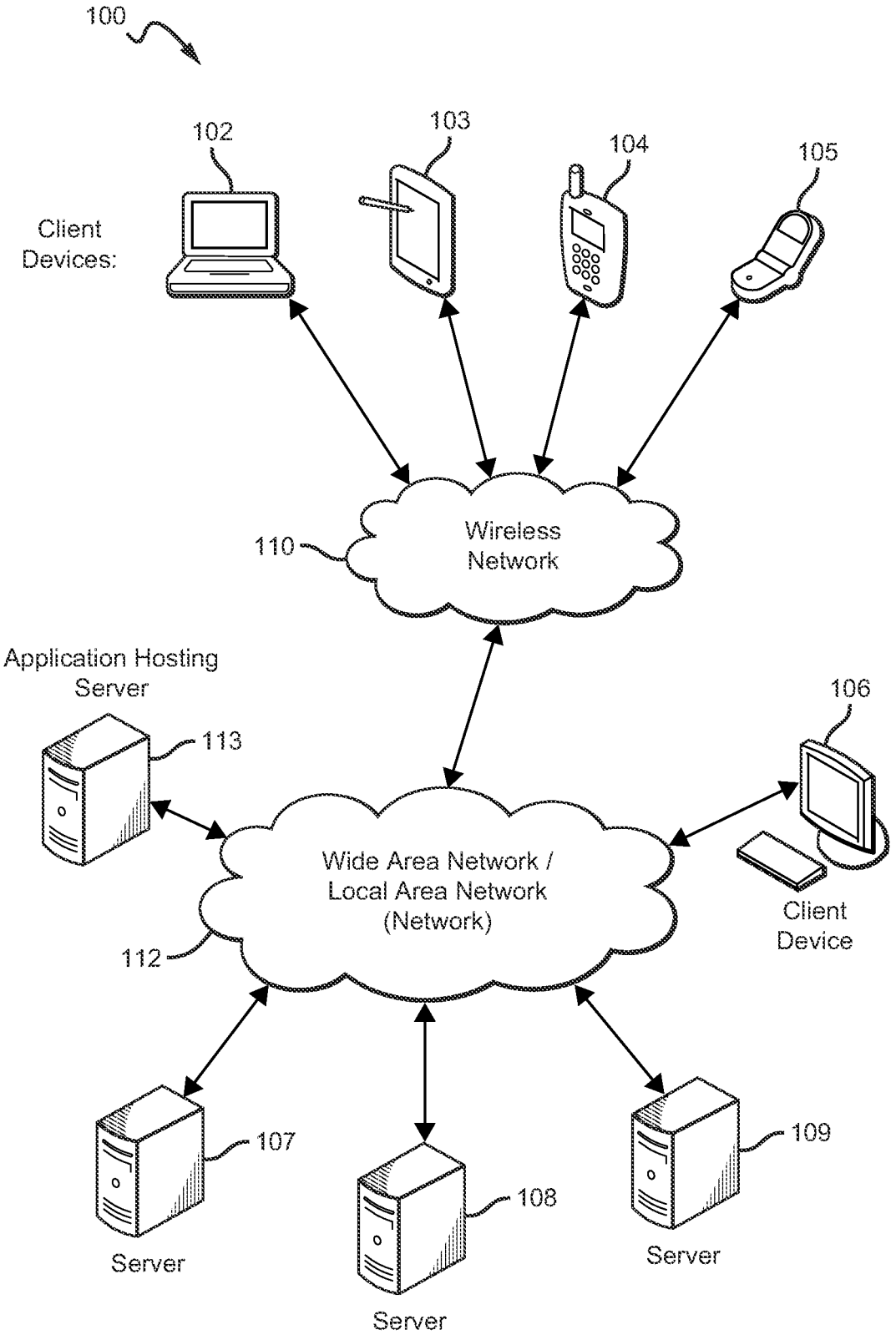
FIG. 1 illustrates a block diagram of a distributed computer system that can implement one or more aspects of an embodiment of the present invention.

FIG. 1 illustrates components of one embodiment of an environment in which the invention may be practiced. Not all of the components may be required to practice the invention, and variations in the arrangement and type of the components may be made without departing from the spirit or scope of the invention. As shown, the system 100 includes one or more Local Area Networks ("LANs")/Wide Area Networks ("WANs") 112, one or more wireless networks 110, one or more wired or wireless client devices 106, mobile or other wireless client devices 102-105, servers 107-109, and may include or communicate with one or more data stores or databases. Various of the client devices 102-106 may include, for example, desktop computers, laptop computers, set top boxes, tablets, cell phones, smart phones, smart speakers, wearable devices (such as the Apple Watch) and the like. Servers 107-109 can include, for example, one or more application servers, content servers, search servers, and the like. FIG. 1 also illustrates application hosting server 113.

Figure 2:
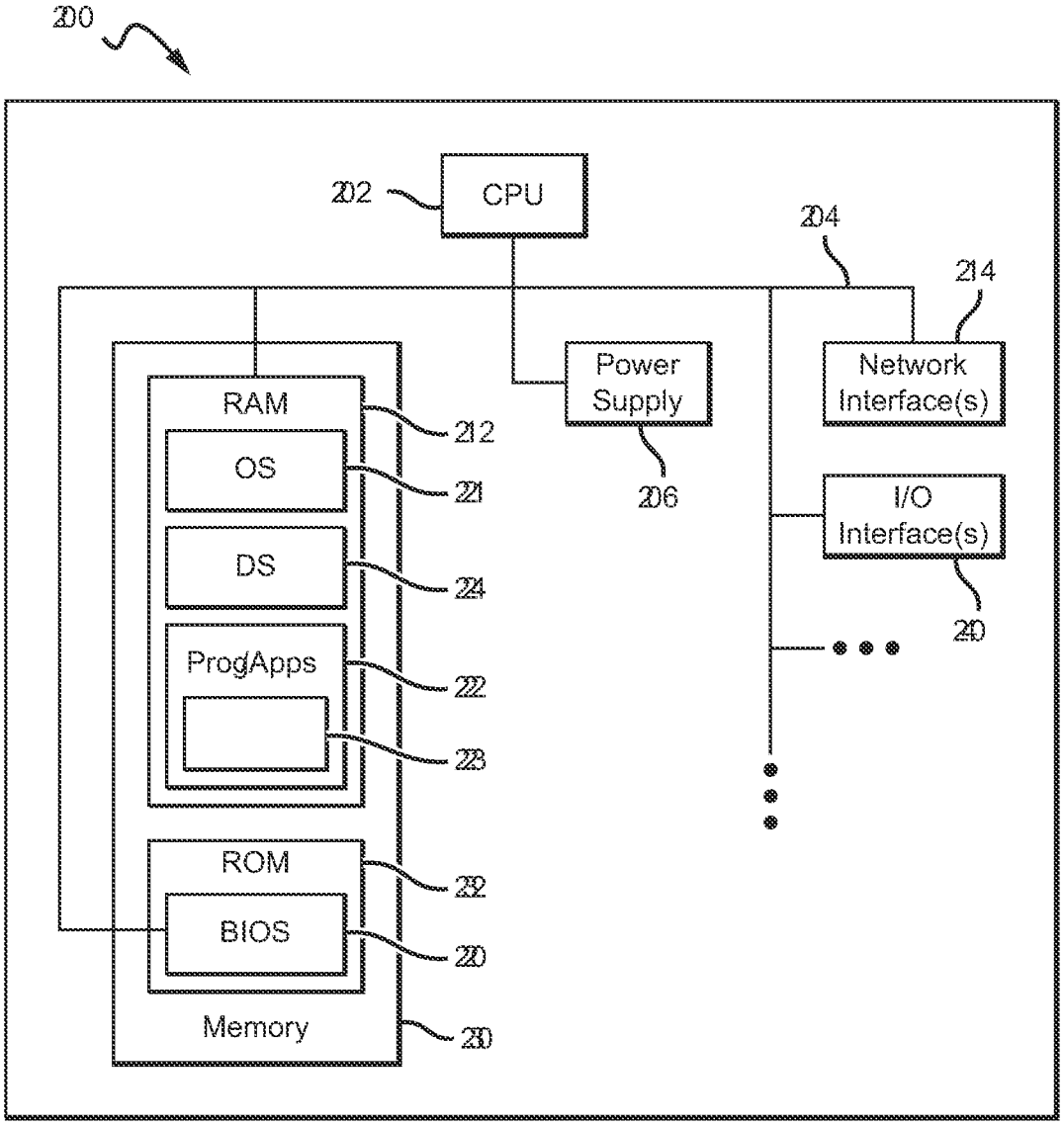
FIG. 2 illustrates a block diagram of an electronic device that can implement one or more aspects of an embodiment of the invention.

FIG. 2 illustrates a block diagram of an electronic device 200 that can implement one or more aspects of an apparatus, system and method for increasing mobile application user engagement (the "Engine") according to one embodiment of the invention. Instances of the electronic device 200 may include servers, e.g., servers 107-109, and client devices, e.g., client devices 102-106. In general, the electronic device 200 can include a processor/CPU 202, memory 230, a power supply 206, and input/output (I/O) components/devices 240, e.g., microphones, speakers, displays, touchscreens, keyboards, mice, keypads, microscopes, GPS components, cameras, heart rate sensors, light sensors, accelerometers, targeted biometric sensors, etc., which may be operable, for example, to provide graphical user interfaces or text user interfaces.

A user may provide input via a touchscreen of an electronic device 200. A touchscreen may determine whether a user is providing input by, for example, determining whether the user is touching the touchscreen with a part of the user's body such as his or her fingers. The electronic device 200 can also include a communications bus 204 that connects the aforementioned elements of the electronic device 200. Network interfaces 214 can include a receiver and a transmitter (or transceiver), and one or more antennas for wireless communications.

The processor 202 can include one or more of any type of processing device, e.g., a Central Processing Unit (CPU), and a Graphics Processing Unit (GPU). Also, for example, the processor can be central processing logic, or other logic, may include hardware, firmware, software, or combinations thereof, to perform one or more functions or actions, or to cause one or more functions or actions from one or more other components. Also, based on a desired application or need, central processing logic, or other logic, may include, for example, a software-controlled microprocessor, discrete logic, e.g., an Application Specific Integrated Circuit (ASIC), a programmable/programmed logic device, memory device containing instructions, etc., or combinatorial logic embodied in hardware. Furthermore, logic may also be fully embodied as software.

The memory 230, which can include Random Access Memory (RAM) 212 and Read Only Memory (ROM) 232, can be enabled by one or more of any type of memory device, e.g., a primary (directly accessible by the CPU) or secondary (indirectly accessible by the CPU) storage device (e.g., flash memory, magnetic disk, optical disk, and the like). The RAM can include an operating system 221, data storage 224, which may include one or more databases, and programs and/or applications 222, which can include, for example, software aspects of the program 223. The ROM 232 can also include Basic Input/Output System (BIOS) 220 of the electronic device.

Software aspects of the program 223 are intended to broadly include or represent all programming, applications, algorithms, models, software and other tools necessary to implement or facilitate methods and systems according to embodiments of the invention. The elements may exist on a single computer or be distributed among multiple computers, servers, devices or entities.

The power supply 206 contains one or more power components, and facilitates supply and management of power to the electronic device 200.

The input/output components, including Input/Output (I/O) interfaces 240, can include, for example, any interfaces for facilitating communication between any components of the electronic device 200, components of external devices (e.g., components of other devices of the network or system 100), and end users. For example, such components can include a network card that may be an integration of a receiver, a transmitter, a transceiver, and one or more input/output interfaces. A network card, for example, can facilitate wired or wireless communication with other devices of a network. In cases of wireless communication, an antenna can facilitate such communication. Also, some of the input/output interfaces 240 and the bus 204 can facilitate communication between components of the electronic device 200, and in an example can ease processing performed by the processor 202.

Where the electronic device 200 is a server, it can include a computing device that can be capable of sending or receiving signals, e.g., via a wired or wireless network, or may be capable of processing or storing signals, e.g., in memory as physical memory states. The server may be an application server that includes a configuration to provide one or more applications, e.g., aspects of the Engine, via a network to another device. Also, an application server may, for example, host a web site that can provide a user interface for administration of example aspects of the Engine.

Any computing device capable of sending, receiving, and processing data over a wired and/or a wireless network may act as a server, such as in facilitating aspects of implementations of the Engine. Thus, devices acting as a server may include devices such as dedicated rack-mounted servers, desktop computers, laptop computers, set top boxes, integrated devices combining one or more of the preceding devices, and the like.

Servers may vary widely in configuration and capabilities, but they generally include one or more central processing units, memory, mass data storage, a power supply, wired or wireless network interfaces, input/output interfaces, and an operating system such as Windows Server, Mac OS X, Unix, Linux, FreeBSD, and the like.

A server may include, for example, a device that is configured, or includes a configuration, to provide data or content via one or more networks to another device, such as in facilitating aspects of an example apparatus, system and method of the Engine. One or more servers may, for example, be used in hosting a Web site, such as the web site www.microsoft.com. One or more servers may host a variety of sites, such as, for example, business sites, informational sites, social networking sites, educational sites, wikis, financial sites, government sites, personal sites, and the like.

Servers may also, for example, provide a variety of services, such as Web services, third-party services, audio services, video services, email services, HTTP or HTTPS services, Instant Messaging (IM) services, Short Message Service (SMS) services, Multimedia Messaging Service (MMS) services, File Transfer Protocol (FTP) services, Voice Over IP (VOIP) services, calendaring services, phone services, and the like, all of which may work in conjunction with example aspects of an example systems and methods for the apparatus, system and method embodying the Engine. Content may include, for example, text, images, audio, video, and the like.

In example aspects of the apparatus, system and method embodying the Engine, client devices may include, for example, any computing device capable of sending and receiving data over a wired and/or a wireless network. Such client devices may include desktop computers as well as portable devices such as cellular telephones, smart phones, display pagers, Radio Frequency (RF) devices, Infrared (IR) devices, Personal Digital Assistants (PDAs), handheld computers, GPS-enabled devices tablet computers, sensor-equipped devices, laptop computers, set top boxes, wearable computers such as the Apple Watch and Fitbit, integrated devices combining one or more of the preceding devices, and the like.

Client devices such as client devices 102-106, as may be used in an example apparatus, system and method embodying the Engine, may range widely in terms of capabilities and features. For example, a cell phone, smart phone or tablet may have a numeric keypad and a few lines of monochrome Liquid-Crystal Display (LCD) display on which only text may be displayed. In another example, a Web-enabled client device may have a physical or virtual keyboard, data storage (such as flash memory or SD cards), accelerometers, gyroscopes, respiration sensors, body movement sensors, proximity sensors, motion sensors, ambient light sensors, moisture sensors, temperature sensors, compass, barometer, fingerprint sensor, face identification sensor using the camera, pulse sensors, heart rate variability (HRV) sensors, beats per minute (BPM) heart rate sensors, microphones (sound sensors), speakers, GPS or other location-aware capability, and a 2D or 3D touch-sensitive color screen on which both text and graphics may be displayed. In some embodiments multiple client devices may be used to collect a combination of data. For example, a smart phone may be used to collect movement data via an accelerometer and/or gyroscope and a smart watch (such as the Apple Watch) may be used to collect heart rate data. The multiple client devices (such as a smart phone and a smart watch) may be communicatively coupled.

Client devices, such as client devices 102-106, for example, as may be used in an example apparatus, system and method implementing the Engine, may run a variety of operating systems, including personal computer operating systems such as Windows, iOS or Linux, and mobile operating systems such as iOS, Android, Windows Mobile, and the like. Client devices may be used to run one or more applications that are configured to send or receive data from another computing device. Client applications may provide and receive textual content, multimedia information, and the like. Client applications may perform actions such as browsing webpages, using a web search engine, interacting with various apps stored on a smart phone, sending and receiving messages via email, SMS, or MMS, playing games (such as fantasy sports leagues), receiving advertising, watching locally stored or streamed video, or participating in social networks.

In example aspects of the apparatus, system and method implementing the Engine, one or more networks, such as networks 110 or 112, for example, may couple servers and client devices with other computing devices, including through wireless network to client devices. A network may be enabled to employ any form of computer readable media for communicating information from one electronic device to another. The computer readable media may be non-transitory. A network may include the Internet in addition to Local Area Networks (LANs), Wide Area Networks (WANs), direct connections, such as through a Universal Serial Bus (USB) port, other forms of computer-readable media (computer-readable memories), or any combination thereof. On an interconnected set of LANs, including those based on differing architectures and protocols, a router acts as a link between LANs, enabling data to be sent from one to another.

Communication links within LANs may include twisted wire pair or coaxial cable, while communication links between networks may utilize analog telephone lines, cable lines, optical lines, full or fractional dedicated digital lines including T1, T2, T3, and T4, Integrated Services Digital Networks (ISDNs), Digital Subscriber Lines (DSLs), wireless links including satellite links, optic fiber links, or other communications links known to those skilled in the art. Furthermore, remote computers and other related electronic devices could be remotely connected to either LANs or WANs via a modem and a telephone link.

A wireless network, such as wireless network 110, as in an example apparatus, system and method implementing the Engine, may couple devices with a network. A wireless network may employ stand-alone ad-hoc networks, mesh networks, Wireless LAN (WLAN) networks, cellular networks, and the like.

A wireless network may further include an autonomous system of terminals, gateways, routers, or the like connected by wireless radio links, or the like. These connectors may be configured to move freely and randomly and organize themselves arbitrarily, such that the topology of wireless network may change rapidly. A wireless network may further employ a plurality of access technologies including 2nd (2G), 3rd (3G), 4th (4G) generation, Long Term Evolution (LTE) radio access for cellular systems, WLAN, Wireless Router (WR)

mesh, and the like. Access technologies such as 2G, 2.5G, 3G, 4G, and future access networks may enable wide area coverage for client devices, such as client devices with various degrees of mobility. For example, a wireless network may enable a radio connection through a radio network access technology such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), Bluetooth, 802.11b/g/n, and the like. A wireless network may include virtually any wireless communication mechanism by which information may travel between client devices and another computing device, network, and the like.

Internet Protocol (IP) may be used for transmitting data communication packets over a network of participating digital communication networks, and may include protocols such as TCP/IP, UDP, DECnet, NetBEUI, IPX, Appletalk, and the like. Versions of the Internet Protocol include IPv4 and IPv6. The Internet includes local area networks (LANs), Wide Area Networks (WANs), wireless networks, and long-haul public networks that may allow packets to be communicated between the local area networks. The packets may be transmitted between nodes in the network to sites each of which has a unique local network address. A data communication packet may be sent through the Internet from a user site via an access node connected to the Internet. The packet may be forwarded through the network nodes to any target site connected to the network provided that the site address of the target site is included in a header of the packet. Each packet communicated over the Internet may be routed via a path determined by gateways and servers that switch the packet according to the target address and the availability of a network path to connect to the target site.

The header of the packet may include, for example, the source port (16 bits), destination port (16 bits), sequence number (32 bits), acknowledgement number (32 bits), data offset (4 bits), reserved (6 bits), checksum (16 bits), urgent pointer (16 bits), options (variable number of bits in multiple of 8 bits in length), padding (may be composed of all zeros and includes a number of bits such that the header ends on a 32 bit boundary). The number of bits for each of the above may also be higher or lower.

A "content delivery network" or "content distribution network" (CDN), as may be used in an example apparatus, system and method implementing the Engine, generally refers to a distributed computer system that comprises a collection of autonomous computers linked by a network or networks, together with the software, systems, protocols and techniques designed to facilitate various services, such as the storage, caching, or transmission of content, streaming media and applications on behalf of content providers. Such services may make use of ancillary technologies including, but not limited to, "cloud computing," distributed storage, DNS request handling, provisioning, data monitoring and reporting, content targeting, personalization, and business intelligence. A CDN may also enable an entity to operate and/or manage a third party's web site infrastructure, in whole or in part, on the third party's behalf.

A Peer-to-Peer (or P2P) computer network relies primarily on the computing power and bandwidth of the participants in the network rather than concentrating it in a given set of dedicated servers. P2P networks are typically used for connecting nodes via largely ad hoc connections. A pure peer-to-peer network does not have a notion of clients or servers, but only equal peer nodes that simultaneously function as both "clients" and "servers" to the other nodes on the network.

Embodiments of the present invention include apparatuses, systems, and methods implementing the Engine. Embodiments of the present invention may be implemented on one or more of client devices 102-106, which are communicatively coupled to servers including servers 107-109. Moreover, client devices 102-106 may be communicatively (wirelessly or wired) coupled to one another. In particular, software aspects of the Engine may be implemented in the program 223. The program 223 may be implemented on one or more client devices 102-106, one or more servers 107-109, and 113, or a combination of one or more client devices 102-106, and one or more servers 107-109 and 113.

The invention described in the present disclosure may utilize any of the following piston pumps, including, but not limited to, lift piston pumps, force piston pumps, axial piston pumps, and radial piston pumps.

In some embodiments, the pump cartridge may include a linear piston pump. The piston may be driven by linear motion generated by the transmission, using a crank. The piston may include an inlet valve, allowing fluid to enter the cylinder when the piston is withdrawn. Upon compression, the inlet valve may close, and a check valve in the cylinder head may open once the pressure in the cylinder exceeds that of the pressure in the outlet tubing.

In an embodiment, the piston pump is made from materials that are rust-resistant. However, the piston pump, in many embodiments, may be made from cast iron, plastic, steel, stainless steel, stainless steel alloys, aluminum, ceramics, or other materials. In an embodiment, the piston, piston pump, and/or other components of the present invention may be 3D printed.

The piston pump may be a single action pump. In another embodiment, the piston pump is a dual action pump. In the dual action pump embodiment, the piston pump may include two inlets and two outlets. The pump may generate up to twelve thousand (12,000) psi of pressure, at a flow rate of 200 ml/min. However, the pump may generate any suitable pressure and/or flow rate values. Moreover, there exist pump embodiments where the piston pump includes more than two inlets and/or more than two outlets.

In an embodiment, the piston pump includes a single piston residing within a piston cylinder. However, there are alternate embodiments where the pump is a duplex pump, a triplex pump, or a pump having more than three pistons. In some multiple-piston embodiments, each piston may have a dedicated controlling device. However, in other multiple-piston embodiments, the same controlling device controls every piston. For the purposes of this disclosure, a controlling device may be, or may include, a computer, a sensor, a detector, or other component.

In an embodiment, the motor speed control apparatus comprises a piston pump, where the piston pump contains a piston. In alternate embodiments the piston pump houses more than one piston. The piston pump may include a number of components, including, but not limited to, an intake, a port plate, a discharge, a rotating barrel, a piston, and a non-rotating swashplate.

Figure 3:
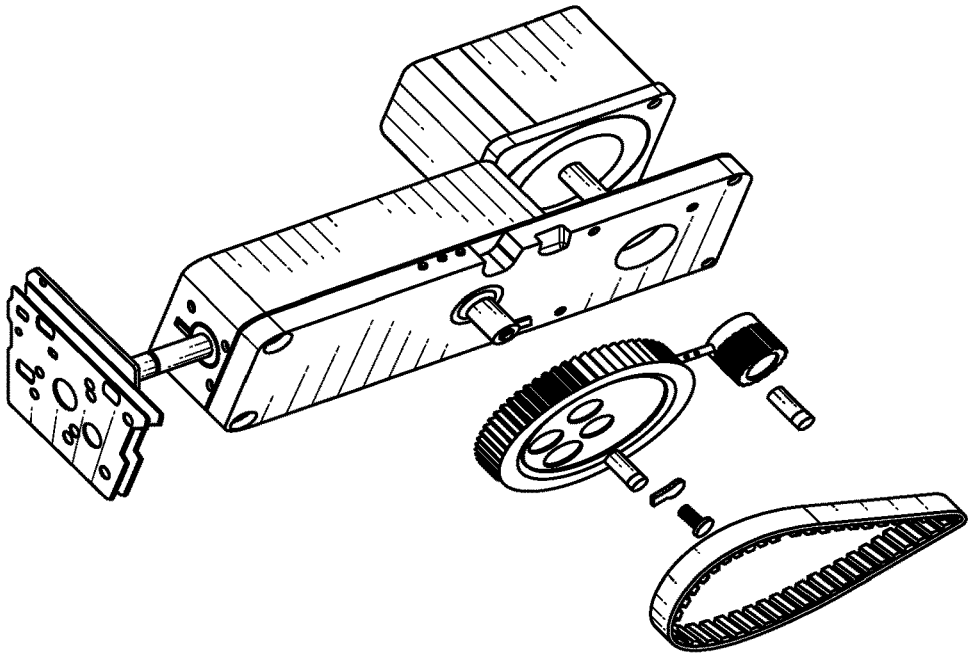
FIG. 3 illustrates an embodiment of a pump motor.

Referring to FIG. 3, in an embodiment, the piston pump is connected to a pump motor with a drive shaft disposed between the pump motor and the piston pump. The drive shaft may transmit the force of the transmission shaft to the piston. The compressive force may be transferred to the piston shaft by the transmission drive shaft as they are in direct contact. The pull force may be transferred to the piston shaft via the coupling of the pins of the comb to the transmission drive shaft.

The cylinder may have a diameter of approximately 9 millimeters. In an embodiment, the length of a compression stroke is approximately 4 millimeters. The volume may be approximately 0.25 $cm^3$. However, the cylinder diameter, length of compression stroke, and volume, may be any suitable measurement. In accordance with various embodiments, the pump may be specifically formed to provide flow rate and pressure necessary to obtain clinical results. However, in alternate embodiments, the pump motor includes a pump motor gear, which is connected to a piston pump gear via a belt. Alternatively, the piston pump gear and the pump motor gear may be connected with a chain, one or more gears, pulley systems, or other suitable components. However, there exist further embodiments where there are multiple gears disposed between the pump motor and the piston pump.

Figure 4:
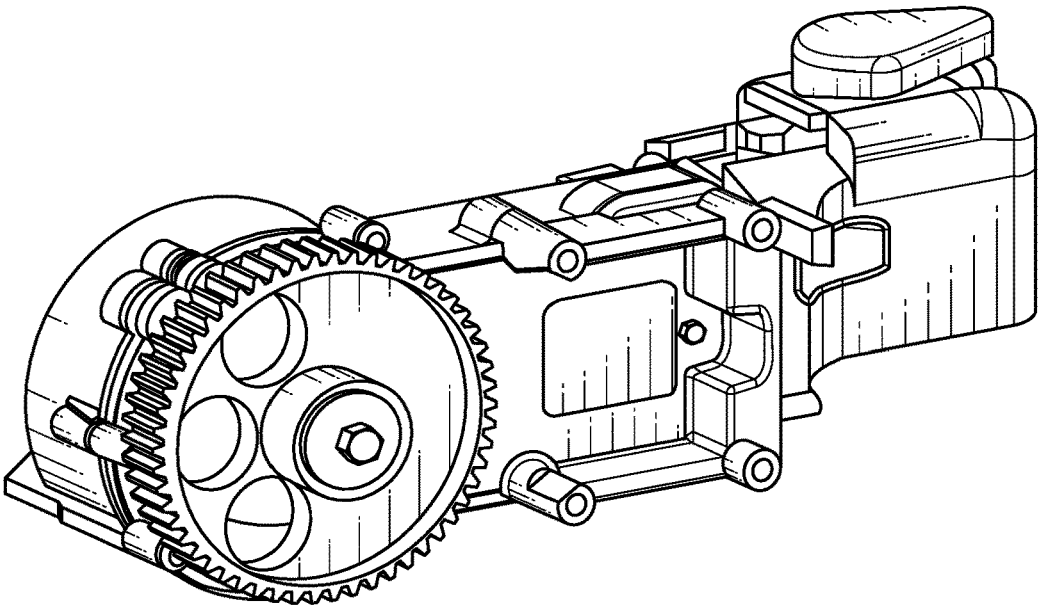
FIG. 4 illustrates an embodiment of a pump motor.

Referring to FIG. 4, in an embodiment, a gear ratio exists between the gear associated with the pump motor and the gear associated with the piston pump. Further, in an embodiment, the gear ratio is 72:17. However, there exist embodiments where the gear ratio is greater or less than 72:17. There are alternate embodiments where the pump motor is connected directly to the piston pump. In this alternate embodiment there is no gear ratio because the pump motor may act as a direct drive motor.

The gear ratio may be determined and configured to match the pump associated with the medical device (or other device), such that the gear ratio may induce the desired speeds in the piston/pump. Thus, the gear ratio may induce a desired piston speed, which may be measured in Turns Per Minute ("TPM"). However, in an embodiment, the gear ratio is configured such that the pump may effectively operate at any of the pre-determined speed settings (for example, 1-10).

The apparatus may include multiple shafts or gears disposed between the pump motor and the piston pump. In these embodiments, the multiple shafts or gears are disposed in such a way as to control the speed of the piston pump. In an embodiment, the pump motor internals are made easily assessable to the user, allowing the user to readily swap gears. In a further embodiment, the invention of the present disclosure includes a gearbox, which may be a manual gearbox or an automatic gearbox. In an embodiment, the manual gearbox is easily manipulated by the user with the aid of lever or other method of control.

In an embodiment, the piston pump is connected to a priming piston pump such that the priming piston pump primes the piston pump. The priming of the handpiece, including the pump cartridge, tubing and other components, may be automated. The pump motor current may be monitored while the motor is in operation. Upon fluid reaching the orifice in the handpiece, the pump motor current may be configured to rise, thereby indicating that the system is primed.

However, in an alternate embodiment, the piston pump is manually primed. There exist further embodiments where the apparatus includes a priming sensor, which is configured to detect whether the pump is primed. There also exists an embodiment where the priming sensor may generate a signal capable of disabling the pump motor or pump based on whether the pump is primed.

In an embodiment, the motor speed control apparatus includes a computer. The computer may be associated with a pump motor, which is a brushless DC motor with speed regulated by the computer. The computer may measure the motor's speed, compare it to a desired speed, and output one or more, such as two, control signals (for example, a pulse width modulated signal and a logical brake signal). The pulse width modulated signal may be proportional to the voltage applied to the motor. The brake signal may actively stop the motor and keep the motor in the stopped position. The one or more signals may feed a commutation controller integrated circuit, or any other suitable controller, which may determine which, and at what polarity, voltage is applied to each of the three phases of the brushless DC motor. This may be determined by monitoring hall effect sensors internal to the motor, which may indicate the relative position between the magnets on the motor shaft and the windings. However, the hall effect sensors may function in accordance with any known hall effect sensor techniques.

For the purposes of this disclosure, the computer may be a microcomputer, a standard desktop computer, or any other computer. In many embodiments, the computer may be small enough, such that it may be housed within the equipment chassis. In another embodiment, the computer may reside within a power supply chassis or pump chassis. In other embodiments, the computer is in electronic communication with the pump motor. However, the computer may also be in communication with the piston pump or any electrical components of the apparatus. There exist further embodiments where the computer is first in electronic communication with a controller or driver (for example, before communicating with the piston pump or pump motor).

In an embodiment, the computer comprises at least a memory and a processor. Also in embodiments, the memory may contain computer-executable instructions (for example, stored on one or more computer-readable storage devices). In many embodiments these instructions are executable by the computer (for example, the processor). In an embodiment, the computer is connected to a monitor such that the user may view the monitor when making adjustments or selecting various settings.

Also, in a further embodiment, the motor speed control apparatus comprises one or more peripheral attachments, such as a computer mouse, track pad, keyboard, or other controller, that enables the user to make selections that relate to the speed of the motor. In alternate embodiments, a means of making adjustments, such as buttons, switches, knobs, or other similar selection tools, are disposed on the outside of the motor control apparatus. In further alternate embodiments, a touch screen, acting as both a monitor and a point of selection, is disposed on the outside of the motor control apparatus.

In an embodiment, the user may control the motor speed via software. For example, the user may adjust speed control settings (for example, from 1-10) by interacting with a Graphical User Interface displayed on a computer monitor or a digital or analog user interface disposed on the apparatus itself. Each of the speed settings may be induce the motor to increase or decrease the speed of the piston, with setting 1 being the lowest speed and 10 being the highest speed.

The computer or the monitor displays sprites and/or graphics for the user that enable the user to make changes to the speed of the motor without interacting with the source code or firmware directly. In certain embodiments, sprites (e.g., animated graphics) may include a series of pictures showing a motion or action. The sprites may be utilized to prompt or direct the user to take a specific action, without the need for text. For example, if the pump cartridge requires insertion into the console, the first picture may illustrate a hand holding the pump cartridge close to the front of the console. The second picture may illustrate the pump cartridge being held, partially in the console, and the third picture may show the hand holding the cartridge completely inserted into the console. The pictures may then cycle through 1-3, dwelling on each one for a period of time, such as one second, until the console senses that the pump cartridge has been plugged in, at which point it would advance to the next state.

However, there are alternate embodiments where the computer enables the user to control more than simply the speed of the motor. For example, in alternate embodiments the computer is configured to allow the user to set a timer for when the pump motor powers up and/or powers down, alter the intensity of the pump motor, and/or adjust other characteristics of the pump motor. In certain embodiments, the user may set the pump speed (for example, speeds 1-10) and determine whether the pump is running or not by the foot pedal. The speed may be selected by up/down, or any other suitable buttons, on the display screen, in conjunction with the foot pedal. An alert, such as a bell, may sound at any suitable interval, such as one minute intervals, so the user may know how much time the pump has run without glancing at the screen.

In an embodiment, each of the pistons is fitted within a piston cylinder and each of the piston cylinders has a proximate and distal end. In this embodiment one or more of the piston cylinders are disposed near one or more hall effect sensors. The one or more hall effect sensors may be used to determine the speed, position, and or trip duration, of the piston as it travels within the piston cylinder. The one or more hall effect sensors may be in electronic communication with the computer.

In some embodiments the computer deciphers the raw data provided by the hall effect sensor to determine the speed and position of the piston. In alternate embodiments, an independent module or microcomputer exists between the one or more hall sensors and the computer. In such an embodiment, said independent module or microcomputer may decipher the raw data provided by the hall effect sensor and convert it to a form easily readable by the computer and/or the computer's processor.

In an embodiment, the one or more hall effect sensors are configured such that the computer receives a signal from the one or more hall effect sensor when a piston approaches within close proximity of top dead center ("TDC") and/or bottom dead center. However, in an alternate embodiment, the hall effect sensor may be configured to generate a signal when the piston approaches any position.

The indexing sensor may be used to determine when the piston is at maximum compression. The sensor utilized may be an optical sensor, such as an interrupt sensor. The interrupt sensor may detect a small hole (for example, 4 mm) in the large pulley of the transmission. The hole may be specifically sized such that the position of the piston can be positioned with the comb linking the shafts of the piston and the transmission. The sensor may be mounted to the transmission such that the light passes through the hole in the pulley, and on to a photodetector when lined up with the hole. The pulley may be aligned on the shaft using a key, such that the small hole aligns with the sensor when the piston is at maximum compression (for example, top dead center) or any desired position.

The indexing sensor may be configured to indicate the location of the piston, in order to lock or unlock the unit to the piston (for example, locking the piston in place). A guillotine and/or a comb may be components of the assembly configured to lock and unlock the piston. For example, the locking and unlocking of the piston may be configured to prevent incident. Accordingly, if the system determined that the piston is not aligned and locked, for example, via the indexing sensor, the unit will be prevented from running In order to ascertain the location of the top dead center, the computer may either power the pump motor at 60 TPM, or slow the pump motor to 60 TPM, and monitor for the index position. However, the computer may instruct the pump motor to operate at any suitable rate. Once detected, the computer may apply the brake. The detection time may be determined by the speed of the photodetector. In some embodiments, the speed of the pump used for indexing may be configured to overcome delays in detection, limit the likely kinetic energy to be absorbed upon braking the motor, and be fast enough such that the user does not experience an unsatisfactory delay.

In some embodiments, the processor determines the speed of a piston by evaluating the times at which the piston triggers the hall sensor and comparing those times to the predetermined distance between the distal and proximate ends of the piston cylinder. The computer may determine the speed of the pump by measuring the time between the indexing signals. The computer may determine the approximate angular position (for example, which may be translated to linear position) by determining the number of pulses from one of the motor internal hall effect sensors after the index sensor is triggered. As a non-limiting example, there may be twenty pulses of the motor hall effect sensor per complete piston cycle. In an embodiment, each of these data points, including, but not limited to, the distance between the proximate and distal end of the piston cylinder, the time at which the hall effect sensor is triggered on the distal end of the piston cylinder, the time at which the hall effect sensor is triggered on the proximate end of the piston cylinder, and the calculated speed of the piston, are populated and stored on a spreadsheet, database, or other data structure on the memory or computer-readable storage devices of the computer.

Although in some embodiments both the proximate end and the distal end of the piston cylinder have separate hall effect sensors, it is possible to only include a single hall effect sensor. In such an embodiment, where a piston cylinder only has one hall effect sensor, the processor calculates speed similarly to previous described embodiments. However, the processor may be programmed to calculate the speed of the piston by comparing the time when the single hall effect sensor is triggered to the distance the piston traveled, where, for the purposes of this embodiment, the piston travels two lengths of the piston cylinder before once again triggering the single hall effect sensor.

Although a hall effect sensor may be used for the foregoing applications, one or more various sensors may be used, including, but not limited to, proximity sensors, pressure sensors, and optical sensors.

In an embodiment, the memory contains computer-executable instructions that, when executed by the processor, cause the pump motor to decelerate before peak compression and the pump motor to accelerate after peak compression. In some embodiments, the decelerating and accelerating of the pump motor by the processor is carried out by a pulse-width modulation controller. Pulse-width modulation may be used to convey information to the motor driver, thereby slowing and speeding up the piston. The computer may calculate duty cycle of the pulse width modulation by the set speed, actual speed, and angular position, or any other suitable variables. The computer may determine the approximate angular position by counting the number of pulses from one of the motor internal hall effect sensors after the index sensor is detected. For example, there may be up to twenty hall effect pulses and one index pulse per complete cycle (revolution).

In another embodiment, the pump motor is accelerated and decelerated by another type of motor speed controller. However, in alternate embodiments, the processor changes the pump motor speed with different methods, for example, by changing the gear ratio, inducing magnets to retard the movement of the pump motor or pistons, or other methods commonly known in the art.

Additionally, in some embodiments, because the peak power required is reduced, the heat released by the motor, and the size of the motor are decreased. Further, in an embodiment, the pumping efficiency is increased because more time is given for the check valve to open, as the compression cycle is longer.

In an embodiment, the user is able to control the rate at which the one or more pistons decelerate and/or accelerate. For example, in some embodiments, the processor may instruct the pump motor to decelerate when the piston is approaching one end of the piston cylinder and has already traveled 90% of the length of the piston cylinder. The motor may begin to accelerate at the detection of the first motor hall pulse after an index is detected, at, for example, a maximum of 18 degrees after TDC. Deceleration of the motor may begin on the fifteenth pulse, after the index is detected, at a maximum value of 270 degrees after TDC. However, there exist embodiments where the piston begins to accelerate and decelerate at different distances along the piston. The processor may also utilize the piston's weight to determine the acceleration and deceleration of the piston.

In an embodiment, the position at which the piston begins to accelerate or decelerate is a function of the speed of the piston. For example, in such an embodiment, if the piston was traveling at 9 meters per second, then the piston may be decelerated when it has traveled 85% the length of the piston cylinder. However, in such an embodiment, if the piston was traveling at 10 meters per second, then the piston may be decelerated when it has traveled 80% the length of the piston cylinder. In an embodiment, the memory contains computer-executable instructions that contain a function to determine at what position a piston should accelerate or decelerate based, in part, on the speed of the piston. For the purposes of the foregoing embodiments, the speed of the piston may be the average speed of the piston, the speed of the piston measured at the center of the piston, or the speed of the piston measured at a different position or in a different manner.

In an embodiment, the operator chooses the position at which the piston accelerates or decelerates. In these embodiments, the operator may make these selections with a peripheral selection device connected to the computer or by using the buttons or switches that may be disposed on the motor speed control apparatus. Alternatively, there exist embodiments where the positions where the piston accelerates and decelerates are fixed, thus non-adjustable.

In an embodiment, the computer or the memory may contain preset modes that dictate when the piston accelerates or decelerates. In these embodiments, the acceleration and deceleration starting points and the intensity of the acceleration and deceleration are tailored to a specific application. The power of the duty cycle to the motor is varied between 75-120% of the needed duty cycle, in order to maintain the desired speed. This may make the current drawn from the power supply more continuous, instead of peaking upon compression. As a non-limiting example, in an embodiment, the computer may have two modes. The first mode may be tailored for motors that are under three horsepower and the second mode may be tailored for motors that are above three horsepower. In some embodiments, the second mode may more drastically accelerate and decelerate the piston before and after peak compression. However, there exist various possible programmable modes.

In alternate embodiments, the piston and/or the piston cylinder may be fitted with a spring or may be in communication with a spring or may be disposed on another component designed to act as a buffer. In an embodiment, a physical component is placed within the piston cylinder, replaces the piston, communicates with the piston, or is captured within the piston, to mitigate the recoil of the piston moving through the piston cylinder.

Although in an embodiment of the motor speed control apparatus a flywheel or counter balance is not required, there exist embodiments where the addition of a flywheel or counter balance may benefit a particular application. Further, although less power may be necessary for pump motor operation, no embodiment should be construed to limit the power rating of a power supply or horsepower of a motor.

In an embodiment, the motor speed control apparatus may include rubber or adjustable feet or legs. In this embodiment the device encapsulating the pump motor may be leveled as to prevent the motor from operating off its axis. Further, in an embodiment, rubber feet may be disposed on the underside of the device that houses the pump motor, as to dampen vibrations and decrease noise pollution. In an embodiment, the housing of the motor speed control apparatus or the housing of the host device is insulated.

Figure 5:
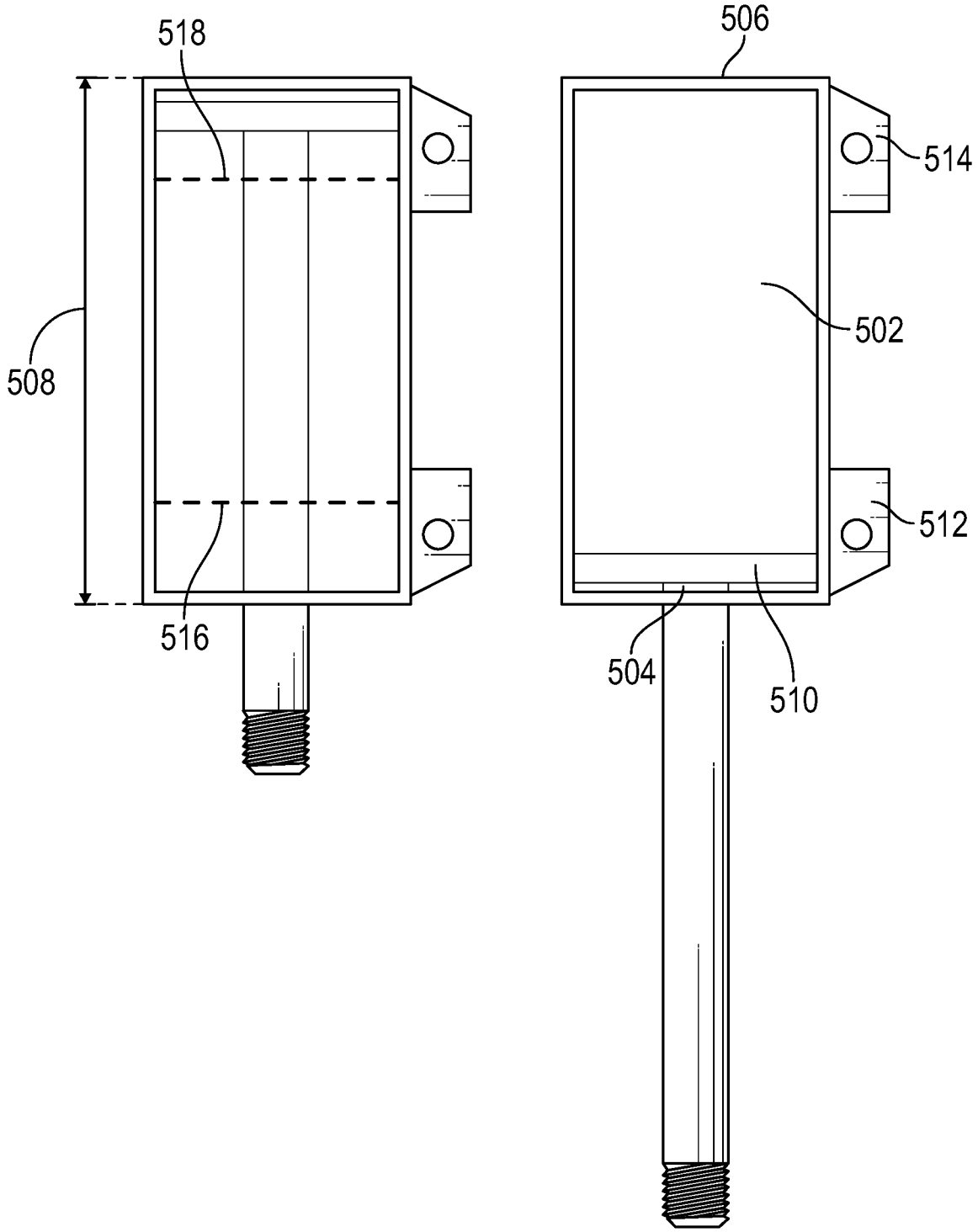
FIG. 5 illustrates an embodiment of a piston cylinder having a reciprocating piston and attached hall effect sensors.

Referring to FIG. 5, the invention of the present disclosure may include a piston cylinder 502 having a proximal end 504 and a distal end 506. A piston length 508 may extend from the proximal end 504 to the distal end 506. A piston 510 may be disposed within the piston cylinder and may follow a linear path. A proximal hall effect sensor 512 may be disposed on the outside surface of the piston cylinder 502, at or near the proximal end 504. A distal hall effect sensor 514 may be disposed on the outside surface of the piston cylinder 502, at or near the distal end 506. The hall effect sensors 512/514 may be positioned such that they may detect the proximity of the piston 504. The piston 510 may be controlled by a computer such that the piston accelerates or decelerates at various points along the piston's travel. For example, the piston 510 may change speeds at the proximal threshold 516 and/or the distal threshold 518.

The invention of the present disclosure may include a motor speed control apparatus for use with a piston pump comprising a piston held captive within the piston pump, the piston configured to travel linearly within a piston cylinder. The piston may be adapted to create a plurality of compressions and the piston may have a compression path and a decompression path. Further, the piston cylinder may include a proximal end, a distal end, and a piston length bound by the proximal end and the distal end. The piston cylinder may have a proximal threshold position and a distal threshold position. In an embodiment, the apparatus further includes a proximal hall effect sensor disposed on an outside surface of the proximal end of the piston cylinder and a distal hall effect sensor disposed on the outside surface of the distal end of the piston cylinder. In a further embodiment, the apparatus comprises a computer comprising one or more processors, one or more computer-readable memories, and one or more computer-readable storage devices, and program instructions stored on at least one of the one or more storage devices for execution by at least one of the one or more processors via at least one of the one or more memories, wherein the computer is in electrical communication with at least the proximal hall effect sensor and the distal hall effect sensor, wherein the memory contains computer executable instructions configured to decrease the speed of the piston before each of the plurality of compressions and increase the speed of the piston after each of the plurality of compressions, wherein the computer executable instructions instruct the piston to begin decelerating at the distal threshold position during the compression path and the proximal threshold position during the decompression path, and/or wherein the computer executable instructions instruct the piston to begin accelerating at the distal threshold position during the decompression path and the proximal threshold position during the compression path.

The motor speed control apparatus may also include an indexing sensor configured to index the piston. In an embodiment, the processor determines the speed of the piston by determining a proximal hall sensor actuation time and a distal proximal hall sensor actuation time, and comparing the proximal hall sensor actuation time, the distal hall sensor actuation time, and the piston length. The piston may be at a top dead center position at the distal end and may be at a bottom dead center position at the proximal end. The acceleration and the deceleration of the piston may be controlled by the processor via a pulse-width modulation controller, where the pulse-width modulation controller configured to convey information to a pump motor. In an embodiment, the locations of the proximal threshold position and the distal threshold position are functions of the piston speed and a piston weight. In a further embodiment, the apparatus includes a first mode and a second mode, wherein the first mode includes an acceleration and deceleration plan for a pump motor under three horsepower, and the second mode includes an acceleration and deceleration plan for the pump motor above three horsepower.

In an embodiment of the invention of the present disclosure is a motor speed control apparatus for use with a piston pump, a piston held captive within the piston pump, the piston configured to travel linearly, wherein the piston is adapted to create one or more compressions, the motor speed control apparatus comprising, a computer comprising a memory and processor, wherein the memory contains computer executable instructions configured to decrease the speed of the piston before the one or more compressions, wherein the memory contains computer executable instructions configured to increase the speed of the piston after the one or more compressions.

While this invention has been described in conjunction with the embodiments outlined above, many alternatives, modifications and variations will be apparent to those skilled in the art upon reading the foregoing disclosure. Accordingly, the embodiments of the invention, as set forth above, are intended to be illustrative, not limiting. Various changes may be made without departing from the spirit and scope of the invention.

What is claimed is:

1. A motor speed control apparatus for use with a piston pump comprising:

a piston held captive within the piston pump, the piston configured to travel linearly within a piston cylinder, wherein the piston is adapted to create a plurality of compressions, wherein the piston has a compression path and a decompression path, wherein the piston cylinder includes a proximal end, a distal end, and a piston length bound by the proximal end and the distal end, and wherein the piston cylinder includes a proximal threshold position and a distal threshold position;

a proximal hall effect sensor disposed on an outside surface of the proximal end of the piston cylinder;

a distal hall effect sensor disposed on the outside surface of the distal end of the piston cylinder; and a computer comprising one or more processors, one or more computer-readable memories, and one or more computer-readable storage devices, and program instructions stored on at least one of the one or more storage devices for execution by at least one of the one or more processors via at least one of the one or more memories, wherein the computer is in electrical communication with at least the proximal hall effect sensor and the distal hall effect sensor, wherein the memory contains computer executable instructions configured to decrease the speed of the piston before each of the plurality of compressions and increase the speed of the piston after each of the plurality of compressions, wherein the computer executable instructions instruct the piston to begin decelerating at the distal threshold position during the compression path and the proximal threshold position during the decompression path, wherein the memory comprises computer executable instructions configured to determine a location of each of the proximal and distal threshold positions according to the speed of the piston and to determine an intensity of the acceleration and the deceleration of the piston, and wherein the computer is configured to alter the intensity of the acceleration and deceleration of the piston.

2. The motor speed control apparatus of claim 1, further comprising an indexing sensor configured to index the piston.

3. The motor speed control apparatus of claim 1, wherein the processor determines the speed of the piston by determining a proximal hall sensor actuation time and a distal proximal hall sensor actuation time, and comparing the proximal hall sensor actuation time, the distal hall sensor actuation time, and the piston length.

4. The motor speed control apparatus of claim 1, wherein the piston is at a top dead center position at the distal end and is at a bottom dead center position at the proximal end.

5. The motor speed control apparatus of claim 1, wherein the acceleration and the deceleration of the piston is controlled by the processor via a pulse-width modulation controller, the pulse-width modulation controller configured to convey information to a pump motor.

6. The motor speed control apparatus of claim 1, wherein the locations of the proximal threshold position and the distal threshold position are functions of the piston speed and a piston weight.

7. The motor speed control apparatus of claim 1, further comprising a first mode and a second mode, wherein the first mode includes an acceleration and deceleration plan for a pump motor under three horsepower, and wherein the second mode includes an acceleration and deceleration plan for the pump motor above three horsepower.

8. The motor speed control apparatus of claim 7, wherein the pump motor has a duty cycle varied between 75-120% of a required duty cycle.

9. The motor speed control apparatus of claim 1, further comprising a flywheel.

10. The motor speed control apparatus of claim 1, wherein the computer executable instructions instruct the piston to begin accelerating at the distal end during the decompression path and the proximal end during the compression path.

11. The motor speed control apparatus of claim 10, wherein the memory contains computer-executable instructions that cause a pump motor to decelerate before peak compression and the pump motor to accelerate after peak compression.

12. The motor speed control apparatus of claim 1, wherein the location of each of the proximal and distal threshold positions are further determined by a weight of the piston.

13. The motor speed control apparatus of claim 1, wherein the piston pump is connected to a priming piston pump.

14. The motor speed control apparatus of claim 13, responsive to the priming piston pump priming the system, a pump motor current is increased.

15. The motor speed control of claim 13, wherein the piston pump comprises a priming sensor configured to detect whether the piston pump is primed.

16. The motor speed control apparatus of claim 1, wherein the speed of the apparatus comprises a plurality of adjustable speed control settings, each of the speed control settings operative to induce a pump motor to increase or decrease the speed of the piston.

17. The motor speed control apparatus of claim 1, wherein the computer comprises a timer configured to control when a pump motor powers up and/or powers down.

18. The motor speed control apparatus of claim 1, further comprising a power supply, wherein the proximal and distal threshold positions and intensity of deceleration permit the piston pump to draw a continuous current from the power supply.

19. The motor speed control apparatus of claim 1, further comprising a pump motor connected to the piston pump, each of the pump motor and the piston pump comprising a plurality of gears, and the gear ratio between the pump motor and the piston pump being 72:17.

20. The motor speed control apparatus of claim 2, further comprising a lock configured to lock the piston in place, and wherein the indexing sensor is configured to indicate a location of the piston in the piston cylinder.

* * * * *